US006740023B2

(12) United States Patent
Schnell

(10) Patent No.: US 6,740,023 B2
(45) Date of Patent: May 25, 2004

(54) FOLDER SUPERSTRUCTURE WITH A COPY DIVERTER, AND PROCESS FOR DIVIDING UP A PRODUCT STREAM INTO TWO SUB-STREAMS

(75) Inventor: Helmut Schnell, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/967,229

(22) Filed: Sep. 28, 2001

(65) Prior Publication Data

US 2002/0084579 A1 Jul. 4, 2002

(30) Foreign Application Priority Data

Sep. 29, 2000 (DE) ..... 100 48 295

(51) Int. Cl.[7] ..... B31F 1/08
(52) U.S. Cl. ..... 493/427; 271/303
(58) Field of Search ..... 493/427; 271/303, 271/302, 304, 272

(56) References Cited

U.S. PATENT DOCUMENTS

| | | | | |
|---|---|---|---|---|
| 2,160,198 A | * | 5/1939 | Clauberg | 270/76 |
| 3,088,731 A | * | 5/1963 | Raybuck | 270/72 |
| 4,273,320 A | * | 6/1981 | Fujishiro | 493/427 |
| 4,373,713 A | | 2/1983 | Loebach | 271/303 |
| 4,538,800 A | * | 9/1985 | Richter | 271/120 |
| 4,666,146 A | | 5/1987 | Richter | 271/303 |
| 4,919,027 A | | 4/1990 | Littleton | 83/107 |
| 5,226,871 A | * | 7/1993 | Skipor | 493/425 |
| 5,547,452 A | * | 8/1996 | Kepert et al. | 493/427 |
| 6,158,736 A | | 12/2000 | Bergeron | 271/303 |
| 6,302,391 B1 | | 10/2001 | Robert | 271/182 |

FOREIGN PATENT DOCUMENTS

| | | | |
|---|---|---|---|
| GB | 1 541 562 | 7/1979 | B65H/29/60 |
| JP | 01 197266 | 8/1989 | |

* cited by examiner

*Primary Examiner*—Rinaldi I. Rada
*Assistant Examiner*—Gloria R Weeks
(74) *Attorney, Agent, or Firm*—Cohen, Pontani, Lieberman & Pavane

(57) ABSTRACT

The folder superstructure is provided with a copy diverter for dividing up a product stream of individual copies. The copy diverter includes at least one rotating disc deflector and a tongue, arranged at a location where the product stream branches into two sub-streams. It is assigned at least one first belt conveying apparatus, which is arranged upstream of the tongue, as seen in the direction of the product stream, and at least one second belt conveying apparatus which is arranged in the region of the tongue. The rotating disc deflector has a plurality of disk segments arranged axially one behind the other on a spindle running transversely to the product stream. In order to set different deflecting positions, the disk segments can be fixed in different circumferential positions.

20 Claims, 6 Drawing Sheets

FOLDER SUPERSTRUCTURE WITH A COPY DIVERTER, AND PROCESS FOR DIVIDING UP A PRODUCT STREAM INTO TWO SUB-STREAMS

BACKGROUND OF THE INVENTION

1. Field of the Invention

The invention relates to a folder superstructure with a copy diverter, having at least one rotating disc deflector and a tongue, for dividing a product stream of individual copies into two sub-streams. A first belt conveying apparatus is arranged upstream of the tongue and a second belt conveying apparatus is arranged in the vicinity of the tongue. The invention also relates to a process for dividing up a product stream into two sub-streams.

2. Description of the Related Art

U.S. Pat. No. 4,373,713 discloses a folder which has the features of the folder superstructure described above, in which a product stream guided vertically between the belt conveying apparatuses comes into contact with a fixed tongue and the copies are deflected alternately into a first or a second product path by disc deflectors arranged to the right and left of the tongue. The disadvantage with this known folder is the rigid arrangement of the disc deflectors, this arrangement only allowing the copies to be deflected alternately.

SUMMARY OF THE INVENTION

The object of the present invention is further to develop an apparatus and a process of the type mentioned in the introduction so as to provide flexible production options in the case of which both alternate deflection into the first or second product path and the introduction of all the copies into a single product path are made possible.

The essence of the present invention is that at least one of the disc deflectors has a plurality of disc segments which can be fixed in different circumferential positions and rotated preferably in relation to one another, with the result that one and the same disc deflector can deflect the copies into different product paths.

It is preferable for each disc segment to assume approximately a circumferential angle of 150°.

The diameters of the disc segments and the spacing between the spindle of the disc deflector and the second belt conveying apparatus are selected such that the relatively large-diameter outer region of the disc segments engages in interspaces between the belts of the second belt conveyor.

In contrast to the prior art described above, the present invention is also distinguished in that, by means of the second belt conveying apparatus, the product stream is guided essentially horizontally past the rotating disc deflector which is arranged beneath the second belt conveying apparatus. In a particularly straightforward embodiment, the gravitational force of the copies thus makes it possible to dispense with a second disc deflector, which is arranged above the second belt conveying apparatus.

According to a preferred embodiment, however, a second disc deflector is arranged above the second belt conveying apparatus, in the region of the tongue, and serves for the positive guidance of the copies into the second, bottom product path.

It is particularly advantageous if a braking arrangement for braking the copies by approximately 40 percent of their arrival speed is arranged upstream of the copy diverter, as seen in the direction of the product stream. This makes it possible to reduce to a considerable extent the wear on the tongue, damage to the copies and smearing of the ink of the newly printed copies.

A process according to the invention is distinguished in that the copies first of all are braked by means of a braking arrangement and are then guided, by means of a second belt conveying apparatus, to a copy diverter provided with a fixed tongue. At least some of the copies are introduced into a first branching path, before reaching the tongue, by disc segments of a first disc deflector, these segments engaging through interspaces between the belts of the second belt conveying apparatus, and other copies are introduced into a second branching path, beneath the tongue, by virtue of the disc segments being rotated away. The braking is preferably approximately 40 percent of the arrival speed.

This process may be modified in that rotation of the disc segments in relation to one another on the first disc deflector produces, in axial projection, a cylinder which, to the greatest possible extent, is closed, with the result that all the copies are guided into the first branching path.

Another modification provides that, by virtue of the disc segments on the first disc deflector being rotated away, all the copies are guided into the second branching path.

An advantageous configuration of the process makes provision for the copies, in the region of the tongue, during introduction into the second branching path, to be guided additionally from above by means of a second disc deflector, which is arranged above the second belt conveying apparatus.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
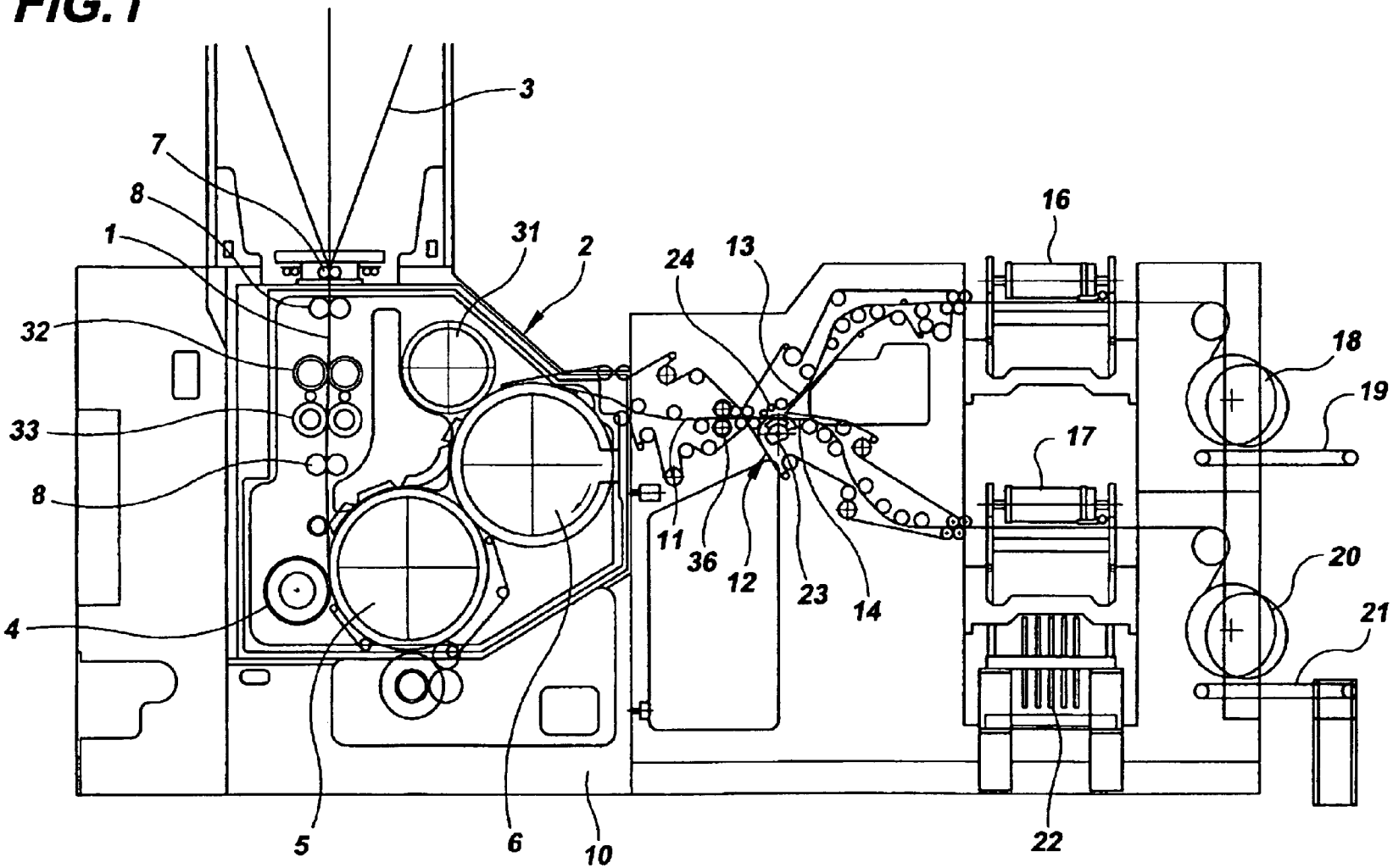
FIG. 1 shows a schematic side view of a folder superstructure.

FIG. 1 shows a folder superstructure 2 which guides a printing-carrier web 1 first of all over a former 3 in order for a first longitudinal fold to be introduced. Arranged downstream of the former 3 is a pair of former rollers 7, a web-tensioning arrangement 8, a cross perforator 32 and a longitudinal perforator 33.

These are followed by a cutting cylinder 4, a pin-type folding-blade cylinder 5 and a jaw cylinder 6. The printing-carrier web 1, which is longitudinally folded via the tip of the former 3, is pinned by the pins of the pin-type folding-blade cylinder 5 and, once the cylinder has been rotated further, is cut into individual copies on the trailing edge by the cutting cylinder 4. If appropriate, a second copy is also collected on the circumference of the pin-type folding-blade cylinder 5 before transfer to the jaw cylinder 6. If required, the copies are also provided with a second, cross fold by means of a gripper-type folding-blade cylinder 31 arranged obliquely above the jaw cylinder 6.

After leaving the jaw cylinder 6, the copies are transported further horizontally by a first belt conveying apparatus 11. A braking arrangement 36 then brakes the copies to approximately 40 percent of the arrival speed thereof before they are directed, at a copy diverter 12, into a first path to a top second longitudinal-folding arrangement 16 or into a second path to a bottom second longitudinal-folding arrangement 17 or alternately into one of these two paths.

The top second longitudinal-folding arrangement 16 is assigned a paddle wheel 18 and a top delivery means 19. The bottom second longitudinal-folding arrangement 17 is assigned a paddle wheel 20 and a bottom delivery means 21. For joint delivery of the copies folded in the top second longitudinal-folding arrangement 16 and the bottom second longitudinal-folding arrangement 17, a third delivery means 22 is provided in the bottom region of the framework 10.

Figure 2:
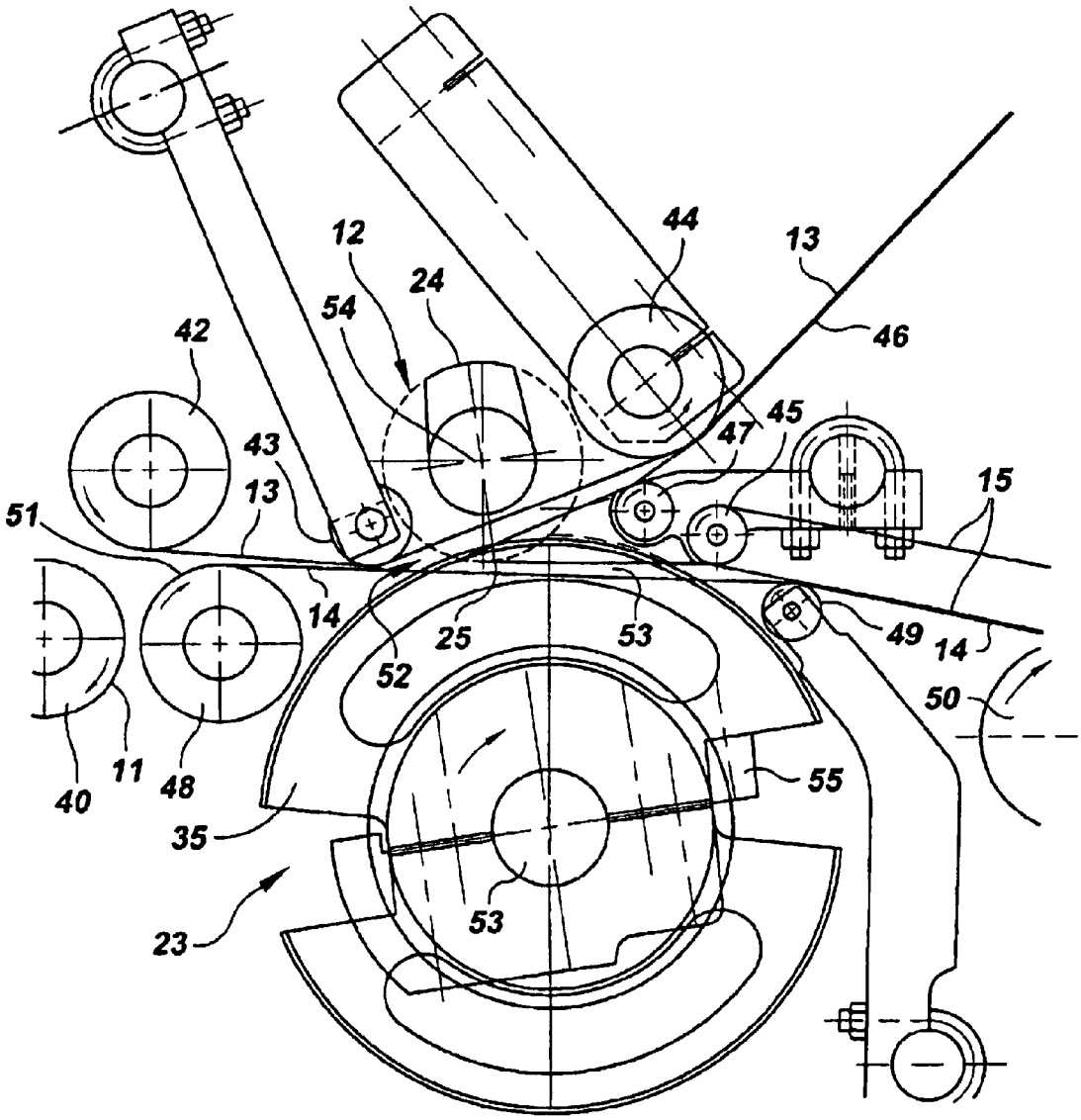
FIG. 2 shows a schematic side view of the copy diverter.

In FIG. 2, the region of the copy diverter 12 is illustrated on an enlarged scale. Starting from the jaw cylinder 6, the copies are guided horizontally by a directing belt 11 from beneath and a directing belt 37 (see FIG. 3) from above. On its extreme right-hand side, the directing belt 11 is deflected downwards by a deflecting roller 40 and guided back to the jaw cylinder 6. Approximately in this region, the top directing belt 37 is also deflected upwards on a deflecting roller 41 and guided back to the jaw cylinder 6. The copies are transferred to further directing belts 14 and 13, which converge in a wedge-shaped gap S1, the directing belt 14 supporting the copies from beneath and the directing belt 13 guiding the copies from above. The copies are fed, by these two directing belts 13 and 14, towards the tip of a tongue 25. A bottom disc deflector 23, which is arranged essentially beneath the directing belt 14, is made up of a plurality of pairs of disc segments 34 and 35 which are offset axially in relation to one another. Whereas the first disc segments 34 are fixed to the shaft 53 of the bottom disc deflector 23, the second disc segments 35 are mounted rotatably on the shaft 53.

Provided above the tongue 25, and essentially above the top directing belt 13, is a top disc deflector 24, which bears on a shaft 54 a cam-like body, of which the external diameter—as the dashed circle line in FIG. 2 shows—is aligned approximately with the bottom boundary surface of the tongue 25. When the cam of the top disc deflector 24 is located approximately in the 7 o'clock position, it closes off a gap S2, which otherwise frees the path into a top branching section between the underside of the directing belt 13 and the top side of the tongue 25.

On the other hand, in the position illustrated in FIG. 2, the disc segments 34 and 35 of the bottom disc deflector 23 block a gap S3, which otherwise frees the path into a bottom branching section between the underside of the tongue 25 and the top side of the directing belt 14.

The top directing belt 13 is guided obliquely upwards to the right, more or less parallel to the top side of the tongue 25, over a deflecting roller 42 and two further deflecting rollers 43 and 44. Provided on the rear side of the tongue 25, in alignment with the top side thereof, is a deflecting roller 47 over which a directing belt 46 is guided, this, in conjunction with the directing belt 13, guiding the copies into the top branching path to the top longitudinal-folding arrangement 16.

Also arranged on the rear side of the tongue 25, in alignment with the underside thereof, is a deflecting roller 45 over which a directing belt 15 is guided, this, in conjunction with the deflecting belt 14, following the gap S3, leading the copies into the bottom branching path to the bottom second longitudinal-folding arrangement 17. The bottom directing belt 14 is guided, to the greatest possible extent parallel to the underside of the tongue 25, over a deflecting roller 48, which is arranged upstream of the bottom disc deflector 23, and a deflecting roller 49, which is arranged downstream of the bottom disc deflector 23. Following the deflecting roller 49, from which the copy path is additionally bounded by the top directing belt 15, the directing belt 14 is guided further obliquely downwards to the right, over a deflecting roller 50, in the direction of the longitudinal-folding arrangement 17.

Figure 3:
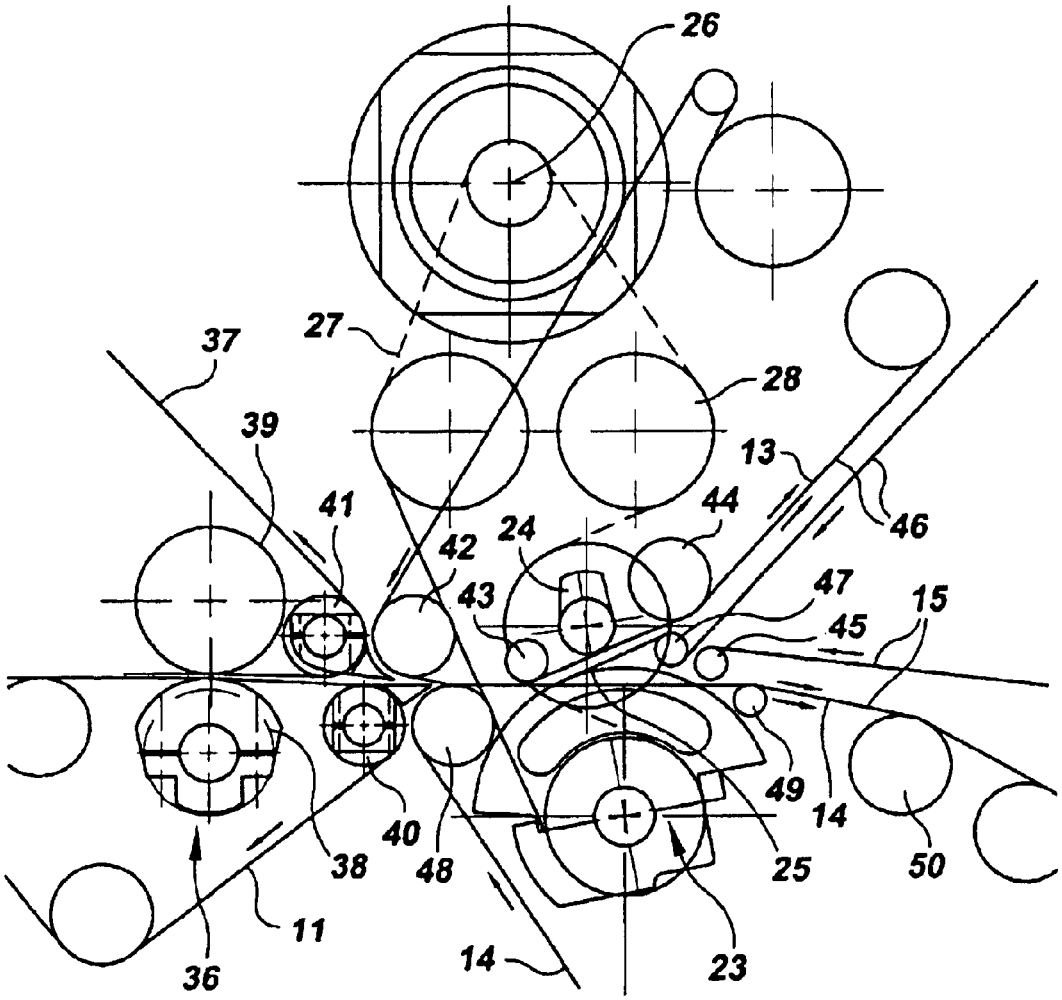
FIG. 3 shows a side view of the drive of the disc deflectors with the belt conveying apparatuses and the braking arrangement.

FIG. 3 illustrates, in addition to the components already shown in FIG. 2, a braking arrangement 36, which is arranged upstream of the copy diverter 12, and also, in schematic form, the drive of the bottom disc deflector 23 and of the top disc deflector 24. The braking arrangement 36 is formed by a braking cylinder 38 which is arranged essentially beneath the directing belt 11 and of which the plurality of spaced-apart discs brake the last third of the length of a horizontally guided copy, if the front two thirds are transferred straight to the directing belts 13 and 14, by way of interspaces between the directing belts 11 and 37, in conjunction with a counterpressure cylinder 39 arranged above the directing belt 37.

Whereas the directing belts 11 and 37 run at the same speed as the pin-type folding-blade cylinder 5 and the jaw cylinder 6, the directing belts 14 and 13, following the braking arrangement 36, run at a speed which is reduced by approximately 40 percent. This has the additional advantage that the copies come into contact with the tongue 25 at reduced speed and thus damage to the copies or to the tongue, or smearing of ink, is avoided. The braking of the copies upstream of the copy diverter is also, in its own right, an inventive further development in comparison with the known prior art since it is possible to operate at a lower speed as early as from the copy diverter, with the result that it is also possible for the following, second longitudinal fold and the delivery to take place at a lower speed, which does not adversely affect the copies. Overall, the operating speed in the folder may optionally also be reduced by up to 40% since the particularly critical operation of splitting up the copies between different paths takes place, as a result of the braking, at a lower speed than in the prior art, that is to say, in turn, at not more than the same as in the prior art.

Figure 6:
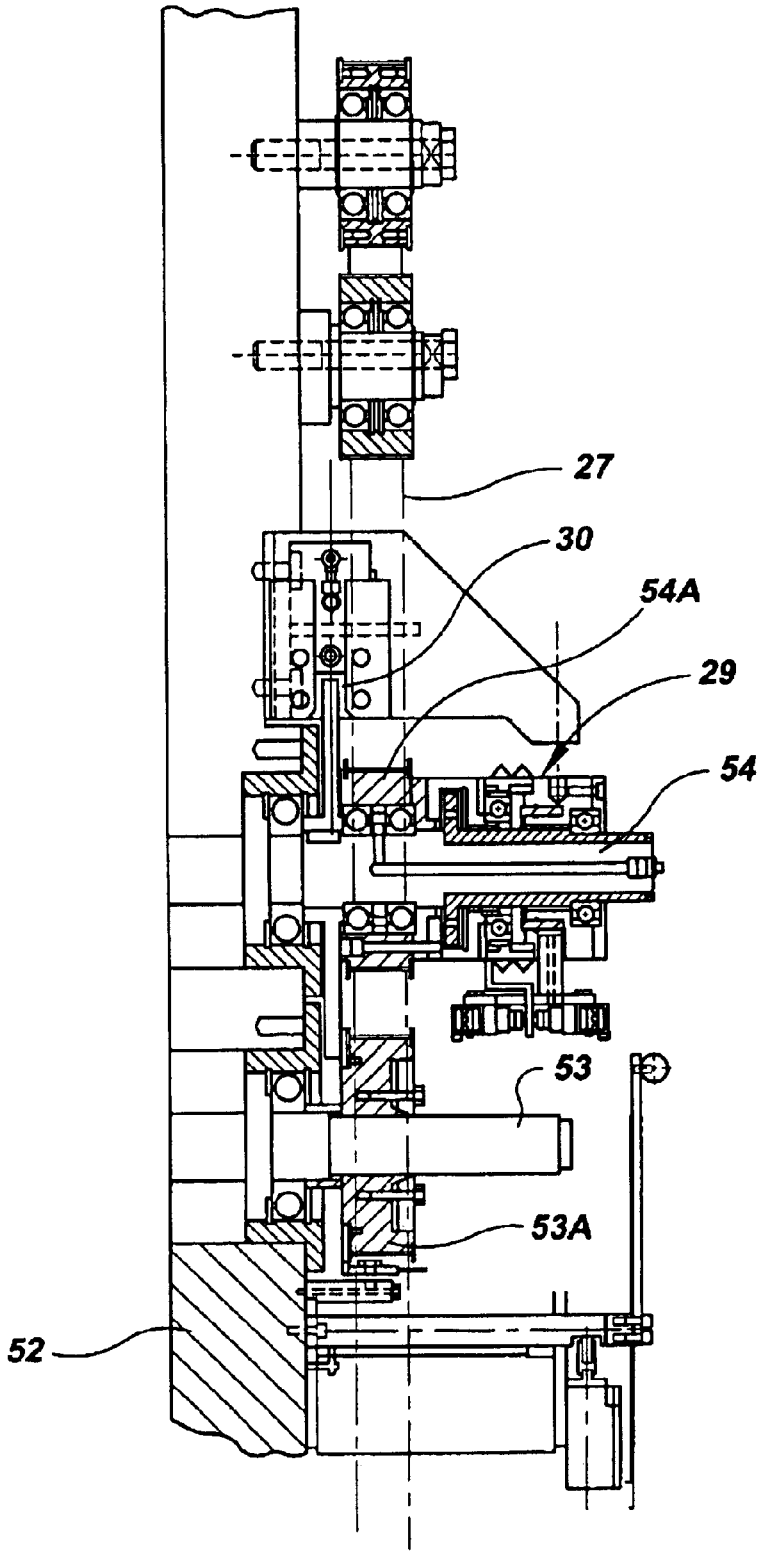
FIG. 6 shows a section through a side wall in the region of the drive of the disc deflectors.

The top disc deflector 24 and the bottom disc deflector 23 are driven via a common electric motor which, via a shaft 26, drives a toothed belt 27 which is guided over a tensioning roller 28, a belt pulley on the shaft 54 of the top disc deflector 24 and a belt pulley on the shaft 53 of the bottom disc deflector 23. These belt pulleys are designated 53A and 54A in FIG. 6. Whereas the belt pulley 53A is fixed to the shaft 53, the belt pulley 54A may be connected in a rotationally fixed manner to the shaft 54 via a coupling 29. It is additionally possible for the shaft 54 to be blocked via a disc brake 30.

Figure 4:
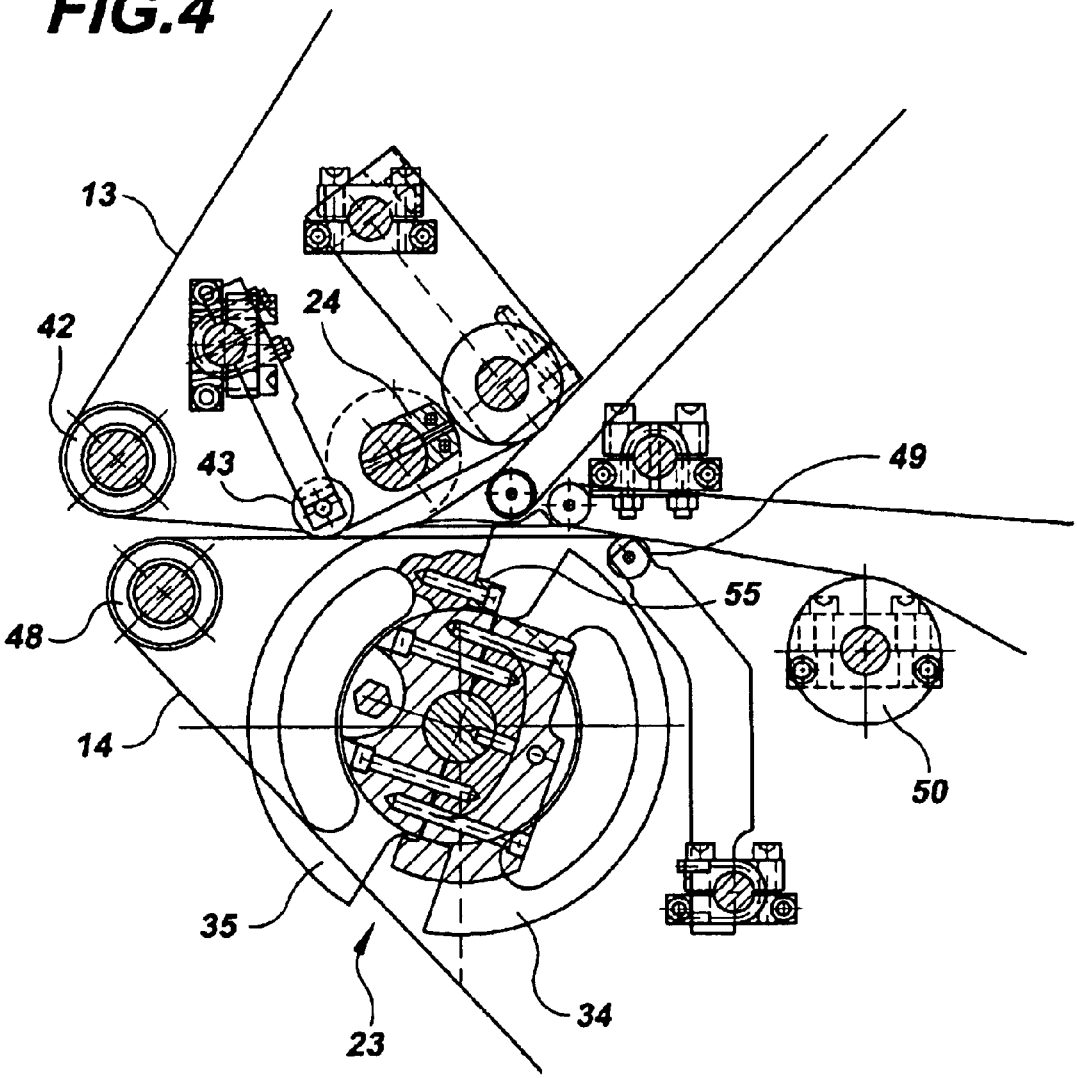
FIG. 4 shows, partly in section, the disc deflectors in detail form.

As is illustrated in FIG. 4, the disc segments 35 of the bottom disc deflector 23 are connected releasably to the shaft 53. For rotation of the releasable disc segments 35 in relation to the fixed disc segments 34, there is provided, for the sake of simplicity, a rotary bar 55, which is fastened on the releasable disc segments 35 and, for its part, may be connected to the shaft 53 in two outer positions. It is thus possible, by virtue of two fastening screws being released, for the entire group of disc segments 35 to be straightforwardly adjusted. Instead of the preferred rotatable mounting of the disc segments 35, it is also possible, in a variant which is particularly straightforward in structural terms, but requires more operational outlay, for the segments to be fastenable manually in different circumferential positions on the shaft 53.

Figure 5:
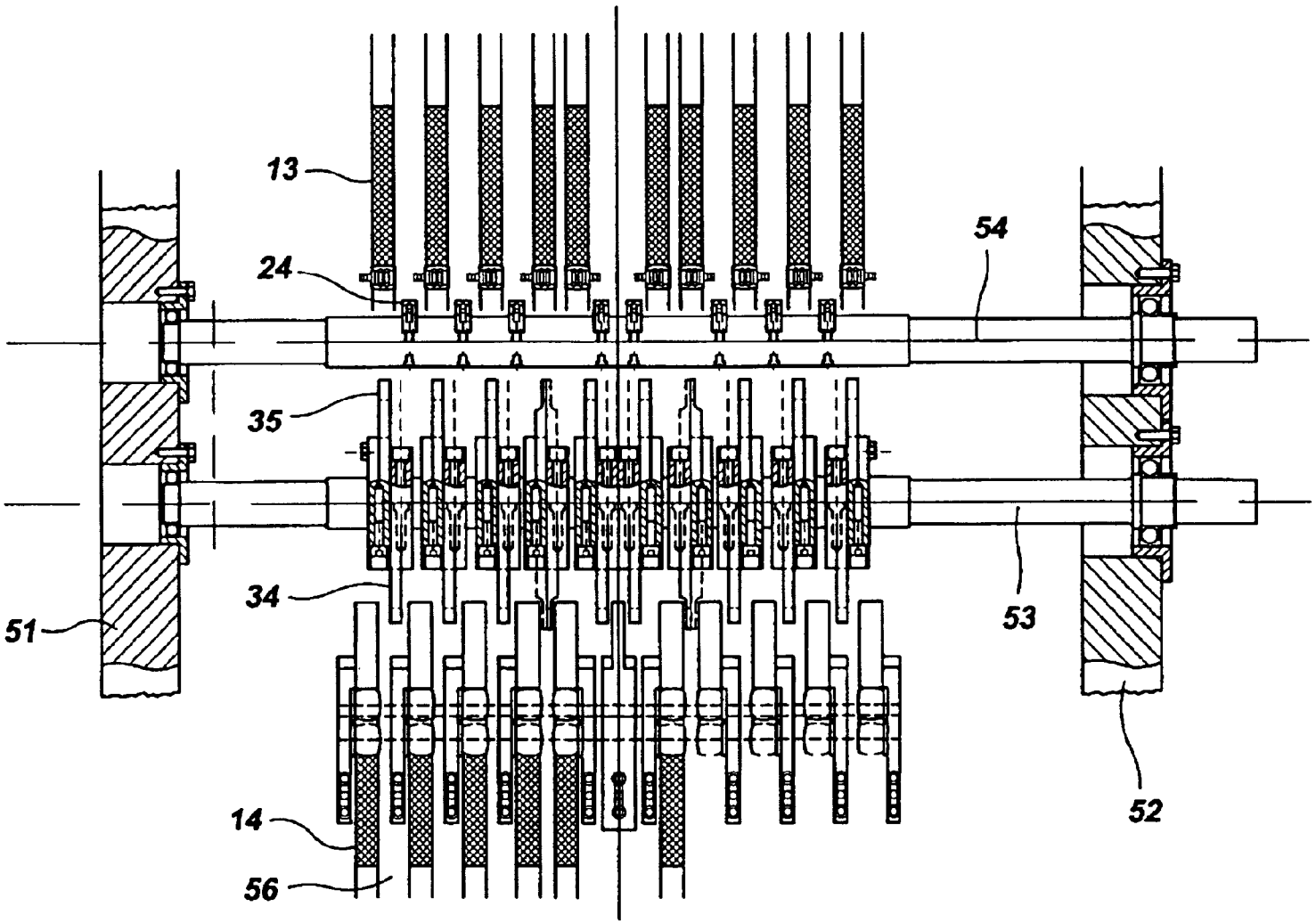
FIG. 5 shows an end view of the disc deflectors and the belt conveying apparatuses.

As can be seen from FIG. 5, both the cams of the top disc deflector 24 and the disc segments 34 and 35 of the bottom disc deflector 23 engage in interspaces 56 between the directing belts 13 and 14. Just as there are a plurality of belts 13 and a plurality of belts 14, there are also a plurality of tongues 25, the disc segments 34, 35 engaging in interspaces between the tongues.

Depending on the type of production desired, the bottom disc deflector 23 and the top disc deflector 24 are used in different ways. In a first type of production, in which the copies are all to be guided into the top copy path to the longitudinal-folding arrangement 16, the disc segments 34 and 35 of the bottom disc deflector 23, as is illustrated in FIG. 2, are rotated in relation to one another such that they form, in axial projection, more or less a solid cylinder. As a result, the disc segments 34 and 35 alternately close off the gap S3 beneath the tongue 25 for each copy. The copies are raised up by the disc segments 34 and 35 upstream of the bottom directing belt 14 and are guided into the gap S2 on the top side of the tongue 25. They are gripped there by the directing belts 13 and 46 and fed to the top longitudinal-folding arrangement 16. The cam of the top disc deflector 24 is located here in the rotated-away position, which is illustrated in FIG. 2 and in which this cam releases the gap S2. The coupling 29 is open in this case and the disc brake 30 is activated, with the result that the shaft 54 is at a standstill and the belt pulley 54A rotates thereon with idling action.

In a second type of production, the copies are guided alternately into the top copy path and the bottom copy path. For this purpose, the disc segments 35 are rotated into a position in which, in axial projection, they are more or less congruent with the disc segments 34, as is illustrated in FIG. 3. In the position shown in FIG. 3, the disc segments 34 and 35 just cover the bottom copy path and the top disc deflector 24 releases the top copy path, with the result that, at this point in time, a copy is fed to the top longitudinal-folding arrangement 16 via the top side of the tongue 25 and the directing belts 13 and 46. If the top disc deflector 24 and the bottom disc deflector 23 have been rotated further approximately through 180 degrees, the top disc deflector 24 closes off the gap S2 by way of its cam, while the bottom disc deflector 23 releases the bottom gap S3, with the result that the following copy is guided into the bottom copy path via the directing belts 14 and 15. With this type of production, the disc brake 30 is open and the coupling 29 connects the belt pulley 54A in a rotationally fixed manner to the shaft 54. The top disc deflector 24 and the bottom disc deflector 23 are driven at the same speed by the drive 26, via the toothed belt 27.

In a third type of production, in the case of which all the copies are introduced into the bottom copy path, the top disc deflector 24 has its cam rotated into a position in which it closes off the gap S2 for the top copy path. In this position, the top disc deflector 24 is arrested by means of the disc brake 30. The bottom disc deflector 23 is rotated further through approximately 180 degrees from the position shown in FIG. 3, with the result that the disc segments 34 and 35 are oriented downwards and release the gap S3. In this case, the drive 26 is at a standstill.

In the case where first of all two copies are collected one above the other on the pin-type folding-blade cylinder 5 prior to transfer to the jaw cylinder 6, the drive 26 runs at half the rotational speed, since there is a larger gap between the copies in each case.

A particularly straightforward embodiment makes provision for the top disc deflector 24 to be omitted. In this case, the copies are guided horizontally into the gap S3 on the bottom directing belt 14 by the gravitational force alone. For deflection upwards into the gap S2, one of the disc segments 34 and 35 of the bottom disc deflector 23 becomes active again.

If the entire apparatus is operated without the braking arrangement 36, it is possible for the directing belt 11 and the directing belt 14 to be combined. The braking arrangement 36, however, is extremely advantageous since, in contrast to known folder superstructures, it is arranged upstream of the copy diverter, with the result that, on account of the improved functioning of the copy diverter, the production speed can be increased to a considerable extent. Also in contrast to known folder superstructures, only a single braking arrangement is necessary, whereas, up until now, each of the second longitudinal-folding arrangements 16 and 17 was assigned its own braking arrangement.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A folder superstructure comprising a first belt conveying apparatus for conveying a product stream of individual copies in a direction, a copy diverter downstream of said first conveying apparatus for directing said product stream into first and second branching paths, said copy diverter comprising at least one tongue and a first disc deflector arranged downstream of said first belt conveying apparatus, said at least one tongue separating said first and second branching paths, said first disc deflector comprising a plurality of first disc segments arranged axially on a shaft running transversely to the product stream, a plurality of second disc segments arranged on said shaft and alternating axially with said first disc segments, and first and second disk segments being axially offset from said at least one tongue, and means for fixing said second disc segments in different circumferential positions relative to said first disc segments in order to set different deflecting positions, and a second belt conveying apparatus in the area of the tongue for conveying said copies in at least one of said branching paths.

2. A folder superstructure as in claim 1 wherein said first disc segments are fixed on said shaft and said second disc segments are rotatable on said shaft.

3. A folder superstructure as in claim 1 wherein said second belt conveying apparatus comprises a plurality of side-by-side belts having interspaces between said belts, said disc segments being axially spaced and having radii such that they engage in said interspaces between said belts.

4. A folder superstructure as in claim 1 wherein said second disc segments can be rotated so that said first disc deflector forms, in axial projection, an essentially closed cylinder which deflects all of the copies into said first branching path.

5. A folder superstructure as in claim 1 wherein said first rotating disc deflector is located beneath said second belt conveying apparatus, said second belt conveying apparatus guiding said product stream horizontally past said first rotating disc deflector.

6. A folder superstructure as in claim 1 further comprising a second disc deflector arranged above said second belt conveying apparatus, said second disc deflector having an external diameter which is substantially flush with said second belt conveying apparatus and an underside of said at least one tongue.

7. A folder superstructure as in claim 6 further comprising a common drive for said first disc deflector and said second disc deflector.

8. A folder superstructure as in claim 7 further comprising a coupling for uncoupling at least one of said first and second deflectors from said common drive.

9. A folder superstructure as in claim 8 further comprising means for arresting said at least one of said disc deflectors which is uncoupled from said drive.

10. A folder superstructure as in claim 1 wherein said second belt conveying apparatus extends continuously, beneath said at least one tongue, to said second branching path.

11. A folder superstructure as in claim 1 further comprising a braking arrangement for reducing the speed of the copies being conveyed on the first belt conveying apparatus.

12. A folder superstructure as in claim 11 wherein said speed is reduced by approximately 40 percent.

13. A folder superstructure as in claim 1 comprising a plurality of said tongues having interspaces between said tongues, said first and second disc segments engaging in said interspaces between said tongues.

14. A folder superstructure as in claim 1 wherein each said disc segment extends over a circumferential angle of approximately 150°.

15. A folder superstructure as in claim 1 wherein said second disc segments can be rotated so that they are axially essentially congruent with said first disc segments.

16. A method for directing a product stream of individual copies into first and second branching paths, said method comprising braking said copies in said product stream by means of a braking arrangement, feeding said copies by means of a belt conveying apparatus to a copy diverter provided with a fixed tongue, said belt conveying apparatus comprising a plurality of side-by-side belts having interspaces between said belts, directing one of said copies into a first branching path above the tongue by means of a first disc deflector arranged beneath said belt conveying apparatus and having a plurality of disc segments which are rotated into said interspaces, and directing one of said copies into a second branching path beneath said tongue by rotating said disc segments out of said interspaces.

17. A method as in claim 16 further comprising rotating a first series of said disc segments with respect to a second series of said disc segments to form a cylinder which, when rotating, directs all of said copies into said first branching path.

18. A method as in claim 16 further comprising rotating said disc segments out of said interspaces so that, when said disc deflector is not rotating, all of the copies are directed into said second branching.

19. A method as in claim 16 further comprising guiding said copies into said second branching path by means of a second disc deflector arranged above the belt conveying apparatus.

20. A method as in claim 16 wherein said copies in said product stream are braked to reduce their speed by 40 percent.

* * * * *